US008704116B2

(12) United States Patent
Akiba et al.

(10) Patent No.: US 8,704,116 B2
(45) Date of Patent: Apr. 22, 2014

(54) LATERAL MOTION MICRO-ELECTRO-MECHANICAL SYSTEM CONTACT SWITCH

(75) Inventors: Akira Akiba, Kanagawa (JP); Koichi Ikeda, Kanagawa (JP)

(73) Assignee: Sony Corporation, Tokyo (JP)

( * ) Notice: Subject to any disclaimer, the term of this patent is extended or adjusted under 35 U.S.C. 154(b) by 325 days.

(21) Appl. No.: 12/929,382

(22) Filed: Jan. 20, 2011

(65) Prior Publication Data

US 2011/0186407 A1 Aug. 4, 2011

(30) Foreign Application Priority Data

Feb. 1, 2010 (JP) ..... 2010-020372

(51) Int. Cl.
*H01H 57/00* (2006.01)

(52) U.S. Cl.
USPC ..... 200/181

(58) Field of Classification Search
USPC ..... 200/181; 307/125

IPC ..... B81B 2201/033; H01H 1/0036,2001/0078, H01H 59/0009

See application file for complete search history.

(56) References Cited

U.S. PATENT DOCUMENTS

| | | | | |
|---|---|---|---|---|
| 5,025,346 | A * | 6/1991 | Tang et al. | 361/283.1 |
| 6,046,659 | A * | 4/2000 | Loo et al. | 333/262 |
| 6,798,315 | B2 * | 9/2004 | Schaefer | 333/105 |
| 2009/0146773 | A1 * | 6/2009 | Kang | 337/123 |
| 2009/0261517 | A1 * | 10/2009 | Yao | 267/160 |

FOREIGN PATENT DOCUMENTS

| | | |
|---|---|---|
| JP | 2008-027812 | 2/2008 |

* cited by examiner

*Primary Examiner* — Vanessa Girardi
(74) *Attorney, Agent, or Firm* — Sony Corporation

(57) ABSTRACT

There is provided a contact switch including: a plurality of first contact points arranged in parallel on a substrate; a movable member including a plurality of beams facing the plurality of first contact points, and formed to be slidable along an alignment direction of the first contact points within a face of the substrate; and a plurality of second contact points provided on faces of the beams, opposing the first contact points, respectively.

14 Claims, 11 Drawing Sheets

LATERAL MOTION MICRO-ELECTRO-MECHANICAL SYSTEM CONTACT SWITCH

BACKGROUND OF THE INVENTION

1. Field of the Invention

The present invention relates to a contact switch used for, for example, control of a high-frequency signal.

2. Description of the Related Art

With the improvement of an integration technique in recent years, size reduction, weight reduction, low voltage operation, low power consumption, and high frequency operation have been rapidly proceeded in electronic devices. In particular, in the technical field of a mobile communication terminal device such as a mobile phone, there is a demand for high performance in addition to the strictly-requested demands described above, and MEMS (micro electro mechanical system) has attracted attention as one of techniques to solve these contradictory issues. The MEMS is a system fusing a micro mechanical component and an electron circuit component by a silicon process technique. With the MEMS technique having excellent characteristics such as precision processability, it is possible to realize a compact and low-cost SoC (system on a chip), while responding to the high performance.

The MEMS technique is utilized in various fields, and is, for example, used for a switch mechanically performing coupling/decoupling of a signal line transmitting a high-frequency signal. In the switch for a high frequency signal, it is desirable to sufficiently reduce power loss (insertion loss) caused by insertion of the switch, and sufficiently improve insulating characteristics to ensure signal quality. A contact switch is cited as a switch satisfying these two characteristics at the same time, and it is utilized as an important component, in particular, in a circuit in which quality is strictly demanded. Further, the contact switch is also expected to be applied to a front-end circuit for high-speed large-capacity communication in a band carrier from a megahertz (MHz ($10^6$ Hz)) to a gigahertz (GHz ($10^9$ Hz)).

Many of the contact switches for the high frequency of the related art have a so-called series type contact structure because of easiness to ensure high isolation, and its wide application range on a circuit design. In the series type contact structure, for example, a signal line is mechanically coupled when a fixed contact point and a movable contact point forming a pair are in contact with each other (an on-state), and mechanically decoupled when they are not in contact with each other (an off-state).

In the switch using the series type contact structure, one of important factors influencing increase/decrease of the insertion loss is contact resistance in a contact section. Low insertion loss is realized as the contact resistance is low, so various techniques have been developed so far. The method most frequently utilized is a method reducing the contact resistance by providing a plurality of movable contact points to one fixed contact point to increase the number of contacts (multi-point contact) (for example, refer to Japanese Unexamined Patent Publication No. 2008-27812)

The contact structure of Japanese Unexamined Patent Publication No. 2008-27812 includes a fixed contact point formed on a substrate, a plurality of movable contact points provided in positions facing the fixed contact point in a cavity, and a movable beam holding these movable contact points. In this structure, the movable beam is displaced by an external drive circuit to switch a contact state and a non-contact state of the fixed contact point and the movable contact point, and this serves as a switch performing coupling/decoupling of the signal line. This contact structure (hereinafter, referred to as a multi-point contact structure) is easily manufactured, and is thus put into practical use in many switches.

SUMMARY OF THE INVENTION

However, like the method of Japanese Unexamined Patent Publication No. 2008-27812, it is difficult to uniformly bring all the contact points into contact in the multi-point contact structure in which the number of contacts are increased. This comes from the following reasons. That is, each distance between each movable contact point and each fixed contact point is equally formed within a possible range in a process, but difference is practically generated due to flatness of a material, and warpage of a member due to internal stress. Further, this difference differs, for example, for each device, each lot, and each wafer of the switch.

The movable beam in Japanese Unexamined Patent Publication No. 2008-27812 is fixed to one point (a fixed section) on the substrate, and displaces by using the fixed section as a fulcrum. In the case where the movable beam displaces to bring the movable contact point into contact with the fixed contact point, a contact point pair in which the distance between the contact points is the smallest is first brought into contact in the plurality of movable contact points. After that, this contact position becomes a new fulcrum of the movable beam, and the spring constant of the movable beam is thus increased on the outer side from this contact position (the opposite side to the fixed section). Accordingly, the contact pressure is low as the contact points are located far from the fulcrum (the fixed section) of the movable beam. In other words, in the multi-point contact structure described above, the contact pressure is varied for each contact point, so contact failure, and a noncontact state easily locally occur. Therefore, it is difficult to obtain sufficient resistance reduction efficiency, and there is an issue that the insertion loss is hardly reduced.

In view of the foregoing, it is desirable to provide a contact switch capable of suppressing insertion loss by reducing contact resistance.

According to an embodiment of the present invention, there is provided a contact switch including: a plurality of first contact points arranged in parallel on a substrate; a movable member including a plurality of beams facing the plurality of first contact points, and formed to be slidable along an alignment direction of the first contact points within a substrate plane; and a plurality of second contact points provided on faces of the beams, opposing the first contact points, respectively.

In the contact switch according to the embodiment of the present invention, a contact state and a non-contact state of the first contact point provided on the substrate, and the second contact point provided on the movable member are switched by slide operation of the movable member, and, for example, this serves as a switch mechanically coupling/decoupling a transmission line. Here, the plurality of first contact points are arranged in parallel, the movable member includes the plurality of beams facing the plurality of first contact points, and the second contact point is provided for each beam, thereby realizing a contact structure in which pairs (contact point pairs) each constituted of the first contact point and the second contact point are parallelized. Therefore, the contact point pairs are mechanically loosely coupled (mechanical interference is unlikely to be generated), while collectively performing the contact operation for all the contact point pairs at the same time, and it is possible to establish the contact in each contact point pair independently from each other. Accordingly, the contact between the contact points is easily established substantially uniformly with sufficient contact pressure.

According to the contact switch of the embodiment of the present invention, the plurality of first contact points are arranged in parallel on the substrate, the movable member includes the plurality of beams facing the plurality of first contact points, and the plurality of second contact points are provided on the beams, respectively. Thus, it is possible to prevent contact failure or the like by uniformizing the contact pressure between the contact points. Thereby, it is possible to suppress the insertion loss by reducing the contact resistance.

Other and further objects, features and advantages of the invention will appear more fully from the following description.

BRIEF DESCRIPTION OF THE DRABLADE SECTIONS

DETAILED DESCRIPTION OF THE PREFERRED EMBODIMENT

An embodiment of the present invention will be hereinafter described in detail with reference to the drawings. In addition, description will be given in the following order.

1. Schematic structure (example of a contact switch in which a movable contact point is provided on a beam of a pushrod)
2. First embodiment (example in which a contact point pair is constituted of two fixed contact points and one movable contact point)
3. Second embodiment (example in which a contact point pair is constituted of two fixed contact points and two movable contact points)
4. Third embodiment (example in which a step is provided between the fixed contact points)
5. Fourth embodiment (example in which a beam is line-symmetrically provided to an operation axis of the pushrod)
6. Application examples (example of an electronic device using the contact switch)

Schematic Structure of Contact Switch

Figure 1A:
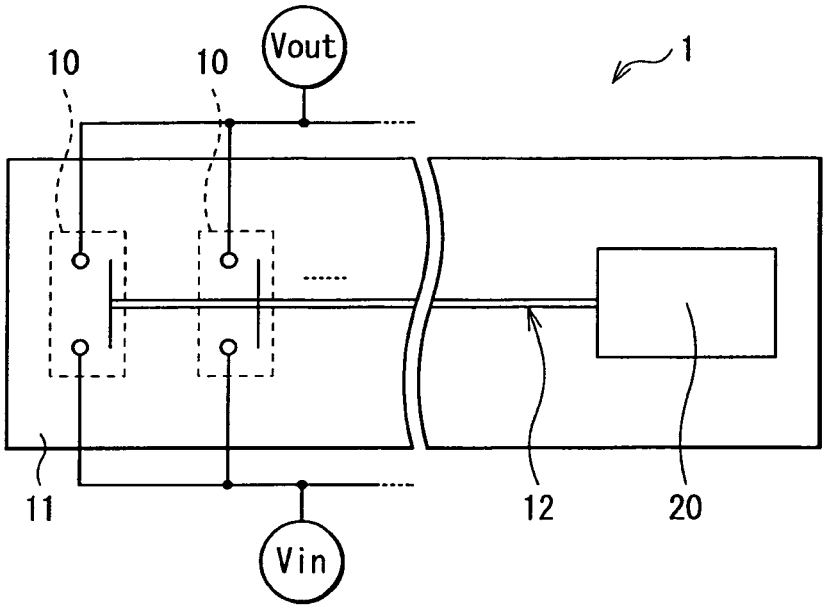
FIGS. 1A and 1B are plan views illustrating a schematic structure of a contact switch according to an embodiment of the present invention.
Figure 1B:
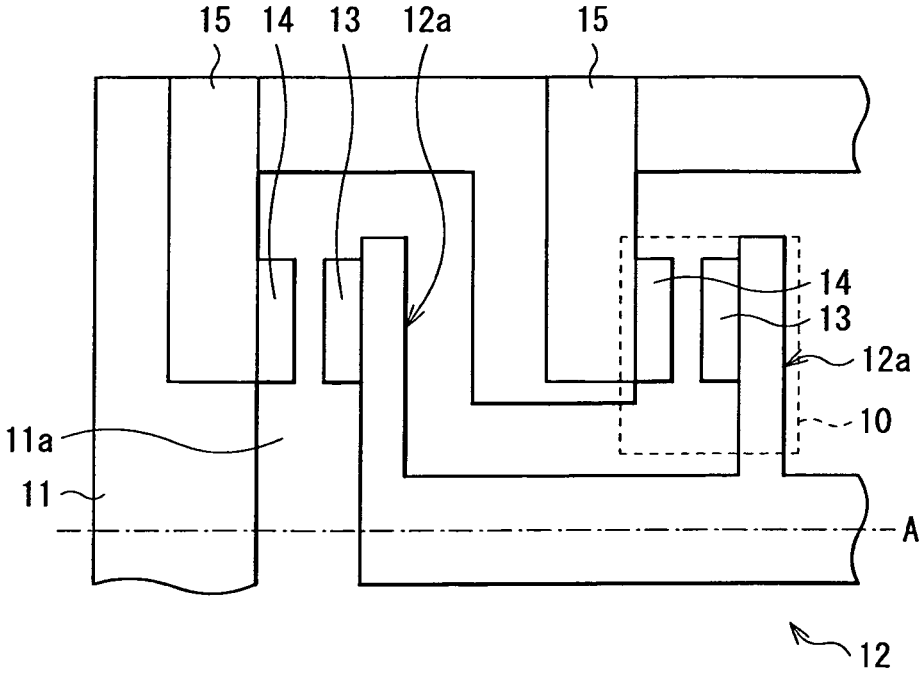

FIGS. 1A and 1B illustrate the schematic structure of a contact switch (a contact switch 1) according to the present invention, FIG. 1A schematically illustrates the overall structure, and FIG. 1B schematically illustrates the structure in the vicinity of a contact point pair. The contact switch 1 includes, for example, a plurality of contact point pairs 10 arranged in parallel on a substrate 11 of a semiconductor or the like, a pushrod 12 (a support body) connected to the plurality of contact point pairs 10, and an actuator 20 driving the pushrod 12. Each contact point pair 10 is connected to a same input port Vin and a same output port Vout through a transmission line 15, respectively, and each circuit formed for each contact point pair 10 is equivalent to each other.

Specifically, as illustrated in FIG. 1B, a cavity 11*a* is formed in a predetermined region in the substrate 11, and a plurality of fixed contact electrodes 14 (first contact points) each serving as a part of the contact point pair 10 are provided in parallel on a wall of the cavity 11*a*. The transmission line 15 is electrically connected to each fixed contact electrode 14. The transmission line 15 is a signal line transmitting a signal, for example, a high-frequency signal between the input port Vin and the output port Vout. Meanwhile, in the cavity 11*a*, the pushrod 12 is slidable along an alignment direction (an operation axis A) of the fixed contact electrodes 14 (the contact point pairs 10) in response to drive of the actuator 20.

The pushrod 12 is, for example, a rod-shaped member extending along the operation axis A. A plurality of contact beams 12*a* is projected from the pushrod 12 toward a direction orthogonal to the operation axis A to face the fixed contact electrodes 14, respectively. The contact beam 12*a* is held in the air in the cavity 11*a* by the pushrod 12, and a movable contact electrode 13 (a second contact point) is provided on a face of each contact beam 12*a*, opposing the fixed contact electrode 14. In other words, the contact point pair 10 is constituted of the contact beam 12*a*, the movable contact electrode 13, and the fixed contact electrode 14, and a contact state (an on-state) and a non-contact state (an off-state) of the movable contact electrode 13 and the fixed contact electrode 14 are switched by slide (position variation along the operation axis A) of the pushrod 12. In addition, the pushrod 12 and the contact beam 12*a* in this embodiment corresponds to a specific example of a movable member in the present invention.

The elastic modulus (for example, Young's modulus) of the contact beam 12*a* is preferably lower than that of the pushrod 12 by setting a material, a thickness, or the like of the contact beam 12*a* and the pushrod 12. In other words, the contact beam 12*a* is preferably regarded as a so-called elastic body, and the pushrod 12 is preferably regarded as a so-called rigid body.

The actuator 20 is, for example, an MEMS actuator processed by using the MEMS technique, and, in particular, an electrostatic actuator (which will be described later in detail) by a lateral drive is suitably used as the actuator 20.

Hereinafter, a preferred embodiment (structure of the contact point pair) of the contact switch 1 will be described in detail. In addition, same reference numerals are used for components identical to those in the schematic structure, and description will be omitted.

1. First Embodiment

Structure of Contact Switch 1A

Figure 2A:
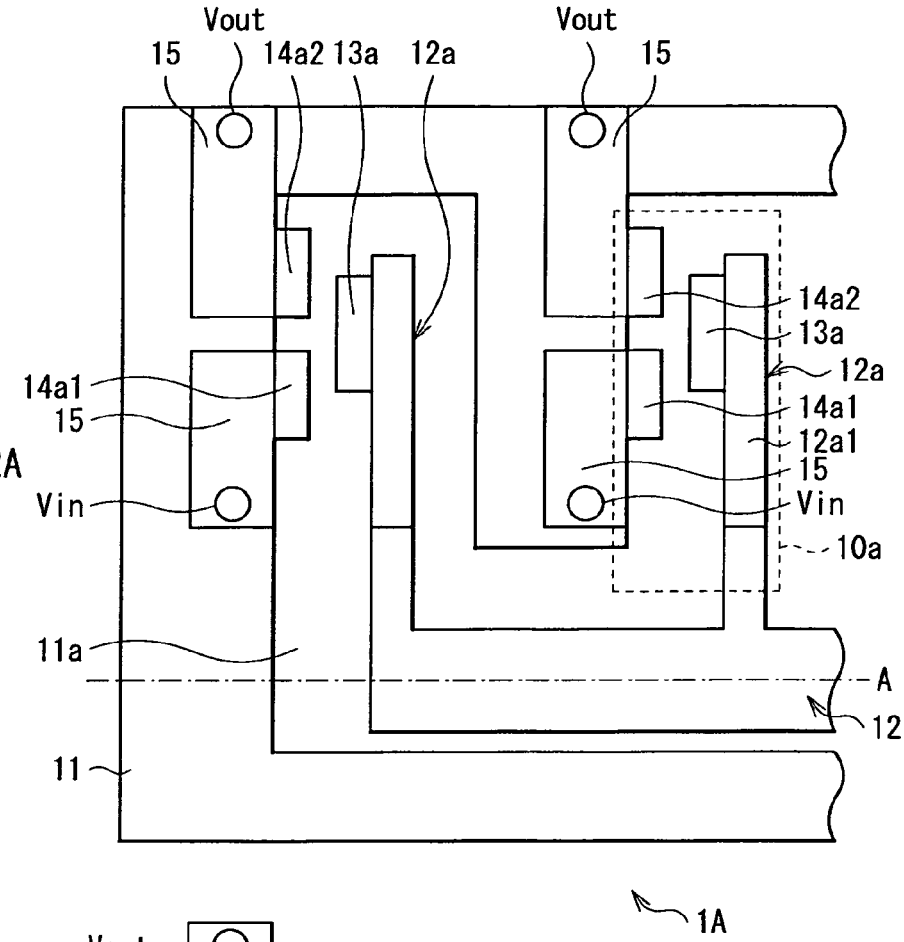
FIGS. 2A and 2B are plan views illustrating the schematic structure of the contact switch according to a first embodiment of the present invention.
Figure 2B:
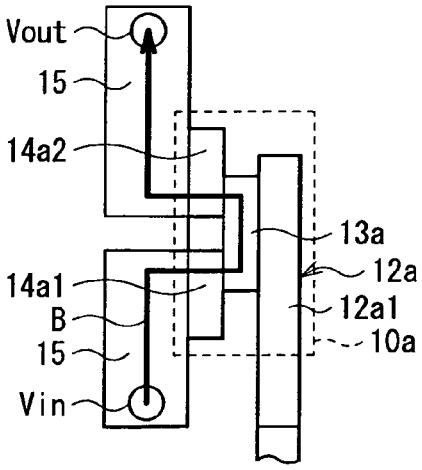

FIG. 2A illustrates the plan structure (off-state) in the vicinity of the contact point pair of the contact switch (a contact switch 1A) according to a first embodiment. In the contact switch 1A, a plurality of contact point pairs 10*a* are arranged in parallel on the substrate 11, and the contact state and the non-contact state in the contact point pair 10*a* are switched by slide operation of the pushrod 12 to perform a so-called series type coupling/decoupling operation. FIG. 2B illustrates the contact point pair 10*a* in the contact state (the on-state), and an arrow B in FIG. 2B schematically illustrates a signal flow.

The substrate 11 is, for example, a substrate made of a Si semiconductor such as silicon (Si), silicon carbide (SiC), silicon germanium (SiGe), and silicon germanium carbon (SiGeC). Alternatively, a substrate made of a non-silicon material such as glass, resin, and plastic may be used as the substrate 11.

The cavity 11*a* is, for example, formed by cutting out the substrate 11 into a comb shape according to an arrangement position of the contact point pair 10*a*, and is a space displaceably accommodating the pushrod 12 and the contact point pair 10*a*. It is possible to form the cavity 11*a* by performing, for example, photolithography and dry etching on the substrate 11. Further, it is possible to form (extract) the pushrod 12 and the contact beam 12*a* at the same time as the etching. On a wall of the cavity 11*a*, the two transmission lines 15 in which the input port Vin and the output Vout are formed, and two fixed contact electrodes 14*a*1 and 14*a*2 connected to the transmission lines 15, respectively, are provided.

The transmission line 15 and the fixed contact electrodes 14*a*1 and 14*a*2 are, for example, a stacked film containing titanium (Ti) and gold (Au) in this order from the substrate 11 side. It is possible to form the stacked film by, for example, sputtering and photolithography, and the thickness of each layer is, for example, 0.1 μm in the titanium, and 0.2 μm in the gold. The transmission line 15 is a fixed electrode formed in a rectangular shape on the substrate 11, and uses methods such as wiring connection, field-through electrode formation, soldering, or Au bump connection to enable the signal input to the input port Vin and the signal output from the output port Vout. In this embodiment, one contact beam 12*a* is arranged to face the two fixed contact electrodes 14*a*1 and 14*a*2, and one movable contact electrode 13*a* is provided on each contact beam 12*a* to face both the fixed contact electrodes 14*a*1 and 14*a*2.

The contact beam 12*a* uses, for example, the same silicon semiconductor material as the substrate 11 and the pushrod 12 as a base material, and the surface of the base material is covered with a stacked film 12*a*1 made of the same material with the same thickness as the fixed contact electrodes 14*a*1 and 14*a*2. The contact beam 12*a* has the elastic modulus lower than that of the pushrod 12. Here, the contact beam 12*a* and the pushrod 12 are formed from the substrate 11 by etching process, so the material of the contact beam 12*a* and the material of the pushrod 12 are the same. However, the contact beam 12*a* is regarded as an elastic body, and the pushrod 12 is regarded as a rigid body, for example, by making the thickness of the contact beam 12*a* smaller than that of the pushrod 12.

Like the fixed contact electrodes 14*a*1 and 14*a*2, the movable contact electrode 13*a* is a stacked film containing titanium (Ti) and gold (Au) in this order from the substrate 11 side. It is possible to form the movable contact electrode 13*a*, for example, by sputtering and photolithography, and the thickness of each layer is 0.1 μm in the titanium, and 0.2 μm in the gold.

Actions of Contact Switch 1A

In this embodiment, when the pushrod 12 slides (displaces) along the operation axis A by the drive of the actuator 20, which is not illustrated in the figure, the contact state and the non-contact state in the contact point pair 10*a* are switched by the slide operation. Specifically, switching from the non-contact state to the contact state, or switching in the other way around (from the contact state to the non-contact state) is performed. When the contact point pair 10*a* is in the non-contact state, the transmission line 15 from the input port Vin to the output port Vout is mechanically decoupled, and switched off (FIG. 2A). Meanwhile, when the contact point pair 10*a* is in the contact state, the transmission line 15 from the input port Vin to the output port Vout is mechanically coupled by the contact point pair 10*a*, and switched on (FIG. 2B). Specifically, a signal input from the input port Vin side is output to the output port Vout through the fixed contact electrode 14*a*1, the movable contact electrode 13*a*, and the fixed contact electrode 14*a*2 in this order.

Figure 3:
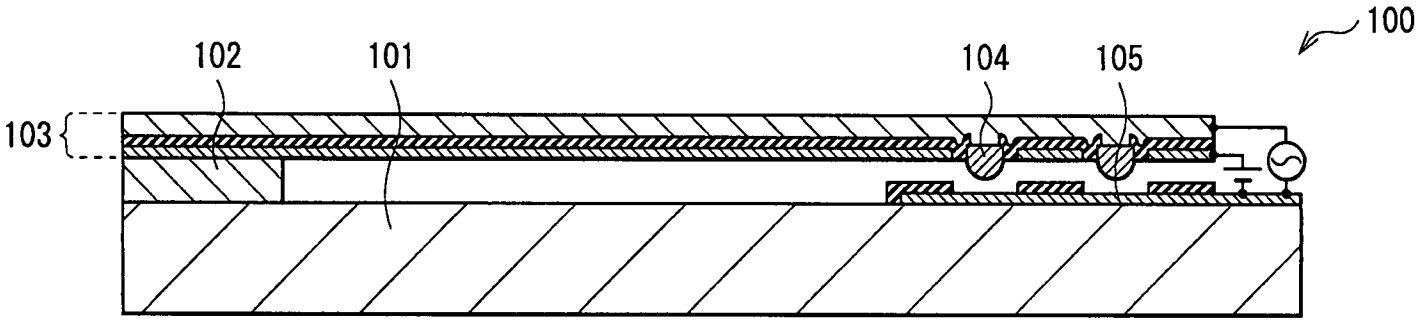
FIG. 3 is a cross-sectional view illustrating the schematic structure of a contact switch according to a comparative example.

Here, with reference to FIG. 3, contact operation between contact points in a contact switch (a contact switch 100) according to a comparative example will be described. In the contact switch 100, a movable beam 103 whose one end is fixed by a fixed section (fulcrum) 102 is provided on a substrate 101, and a plurality of (in this case, two) movable contact electrodes 104 are formed on the movable beam 103. A fixed contact electrode 105 is disposed to face the movable contact electrodes 104 through a cavity on the substrate 101. In this structure, the movable beam 103 is displaced to establish a multi-point contact between the plurality of movable contact electrodes 104 and the fixed contact electrode 105, thereby realizing reduction of the contact resistance.

However, like the contact switch 100, in the case where the plurality of movable contact electrodes 104 are provided to the one movable beam 103, it is difficult to uniformly bring all the contact points into contact. This comes from the following reasons. That is, each distance (space) between each movable contact and each fixed contact is equally formed within a possible range in a process, but difference is practically generated due to flatness of a material, and warpage of a member due to internal stress. Further, this difference differs, for example, for each device, each lot, and each wafer of the switch. Further, in the comparative example, the distance between each contact point pair (the movable contact point and the fixed contact point) is arranged to be narrow to such a degree that the movable beam 103 can be regarded as a rigid body.

The movable beam 103 is displaced by using the fixed section 102 as the fulcrum on the substrate 101. Thus, when the movable beam 103 is displaced to bring the contact points into contact, the movable contact electrode 104 arranged closest to the fixed section 102 is expected to be brought into contact with the fixed contact point first in the plurality of movable contact electrodes 104. After that, this contact position becomes a new fulcrum of the movable beam 103, and the spring constant of the movable beam 103 is thus increased on the outer side from this contact position (the opposite side to the fixed section 102). The increase rate of the spring constant is low, if the movable beam 103 is originally flexible, but the increase rate of the spring constant is high, because a rigid spring is typically employed as the movable beam 103 in many cases to ensure the contact pressure of the contact points and reduce the contact resistance. Accordingly, the contact pressure is low as the contact point is located far from the fulcrum (the fixed section 102) of the movable beam 103. In other words, the contact pressure is varied for each contact point, so contact failure and a noncontact state easily locally occur. If the movable beam is driven so that force necessary for the contact is stronger or the contact time is longer, it is possible to sufficiently bring all the contact points into contact. However, the size of the actuator or the size of the whole element is increased in this case, so it is not efficient. In other words, it is difficult to obtain sufficient resistance reduction efficiency, and insertion loss is hardly reduced in the multi-point structure as described above.

On the other hand, in this embodiment, the plurality of the pairs of two fixed contact electrodes 14*a*1 and 14*a*2 are arranged in parallel on the substrate 11, and the pushrod 12 includes the contact beam 12*a* facing the pair of fixed contact electrodes 14*a*1 and 14*a*2. The one movable contact electrode 13*a* is formed on each contact beam 12*a* to face both the fixed contact electrodes 14*a*1 and 14*a*2. Thereby, the contact structure in which the contact point pairs 10*a* each constituted of the fixed contact electrodes 14*a*1 and 14*a*2, the movable contact electrode 13*a*, and the contact beam 12*a* are parallelized is realized. Therefore, it is possible to mechanically loosely couple the contact point pairs 10*a* (mechanical interference is unlikely to be generated), while collectively performing the contact operation for all the contact point pairs 10*a* at the same time. In other words, each contact operation in all the contact point pairs 10*a* is performed independently from each other. Accordingly, the contact between the two fixed contact electrodes 14*a*1 and 14*a*2 and the movable contact electrode 13*a* in all the contact point pairs 10*a* is substantially uniformly established with sufficient contact pressure.

As described above, in this embodiment, the plurality of fixed contact electrodes 14*a*1 and 14*a*2 are arranged in parallel on the substrate 11, the plurality of contact beams 12*a* facing the fixed contact electrodes 14*a*1 and 14*a*2 are provided in the pushrod 12, and the movable contact electrode 13*a* is provided on each contact beam 12*a*. It is thus possible to prevent contact failure or the like by uniformizing the contact pressure in each contact point pair 10*a*. It is thereby possible to suppress the insertion loss by reducing the contact resistance. Further, more contact points are stably brought into contact, and the contact switch with less insertion loss is realized, in particular, in a transmission line for a high-frequency signal.

Further, the elastic modulus of the contact beam 12*a* is lower than that of the pushrod 12 so that, for example, the contact beam 12*a* is regarded as an elastic body, and the pushrod 12 is regarded as a rigid body. It is thus possible to uniformize the contact pressure in each contact point pair 10*a*. Here, each distance (distance between the contact points) between the movable contact electrode 13*a*, and the fixed contact electrodes 14*a*1 and 14*a*2 in each contact point pair 10*a* is equally designed within a possible range in a process, but difference is practically generated due to flatness of a material, warpage of a member due to internal stress, or the like. Further, this difference differs, for example, for each device, each lot, and each wafer of the switch. As in this embodiment, even if each distance between the contact points is varied as described above, the contact beam 12*a* is regarded as the elastic body, and it is thus possible to reduce the contact pressure difference between the contact points caused by that variation, that is, it is possible to uniformize the contact pressure. Uniformization of the contact pressure improves stability in the coupling/decoupling operation of the contact points, and leads to improvement of reliability in the device. Further, sufficiently low contact resistance is easily realized with low pressure, and this leads to size reduction of the actuator and reduction of the control power.

2. Second Embodiment

Figure 4A:
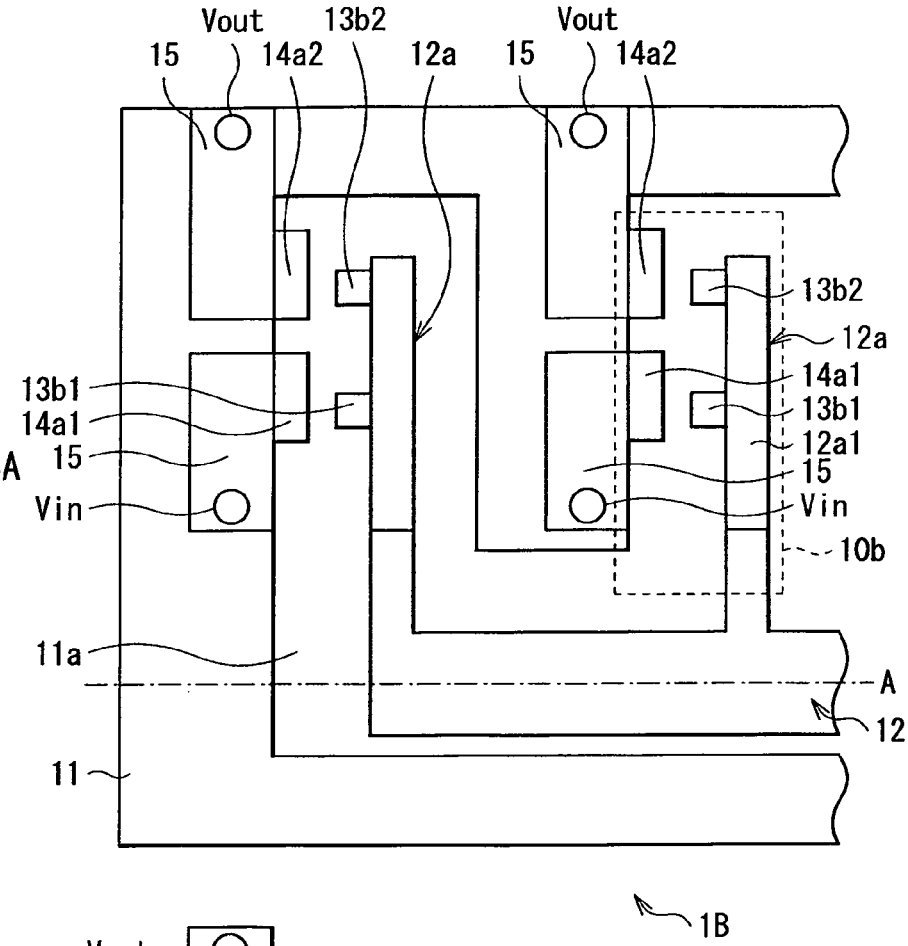
FIGS. 4A and 4B are plan views illustrating the schematic structure of the contact switch according to a second embodiment.
Figure 4B:
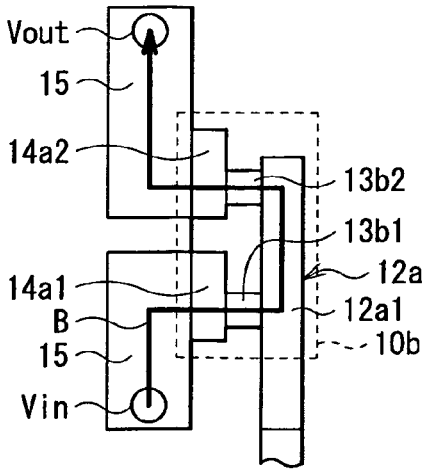

FIG. 4A illustrates the plan structure (the off-state) in the vicinity of the contact point pair (a contact point pair 10*b*) of the contact switch (a contact switch 1B) according to a second embodiment. FIG. 4B illustrates the contact point pair 10*b* in the contact state (the on-state), and an arrow B in the figure schematically illustrates a signal flow. In addition, same reference numerals will be used for components substantially identical to those in the schematic structure and the first embodiment described above, and description will be appropriately omitted.

Like the contact switch 1A in the first embodiment, the contact switch 1B is the series type switch in which the plurality of contact point pairs 10*b* are arranged in parallel on the substrate 11, and the mechanical coupling/decoupling of the transmission line 15 is performed by the slide operation of the pushrod 12. On the wall of the cavity 11*a* formed on the substrate 11, the two transmission lines 15 in which the input port Vin and the output Vout are formed, and the two fixed contact electrodes 14*a*1 and 14*a*2 connected to the transmission lines 15, respectively, are provided. The contact beam 12*a* is projected from the pushrod 12 to face the fixed contact electrodes 14*a*1 and 14*a*2, and the elastic modulus of the contact beam 12*a* is smaller than that of the pushrod 12.

However, in this embodiment, two movable contact electrodes 13*b*1 and 13*b*2 are provided to the two fixed contact electrodes 14*a*1 and 14*a*2 in each contact point pair 10*b*. Specifically, in each contact beam 12*a*, the movable contact electrode 13*b*1 is provided to face the fixed contact electrode 14*a*1, and the movable contact electrode 13*b*2 is provided to face the fixed contact electrode 14*a*2, respectively. Like the movable contact electrode 13*a* in the first embodiment, the movable contact electrodes 13*b*1 and 13*b*2 each are a stacked film containing titanium and gold in this order from the substrate 11 side. The thickness of each layer is, for example, 0.1 μm in the titanium, and 0.2 μm in the gold.

Thereby, like the first embodiment, when the pushrod 12 slides (displaces) along the operation axis A by the drive of the actuator 20, which is not illustrated in the figure, the contact state and the non-contact state in the contact point pair 10*b* are switched by the slide operation in this embodiment. When the contact point pair 10*b* is in the non-contact state, the transmission line 15 from the input port Vin to the output port Vout is mechanically decoupled, and switched off (FIG. 4A). Meanwhile, when the contact point pair 10*b* is in the contact state, the transmission line 15 from the input port Vin to the output port Vout is mechanically coupled by the contact point pair 10*b*, and switched on (FIG. 4B). Specifically, a signal input from the input port Vin side is output to the output port Vout through the fixed contact electrode 14*a*1, the movable contact electrode 13*b*1, the contact beam 12*a* (the stacked film 12*a*1), the movable contact electrode 13*b*2, and the fixed contact electrode 14*a*2 in this order.

Here, the plurality of the pairs of fixed contact electrodes 14*a*1 and 14*a*2 are arranged in parallel on the substrate 11, and the two movable contact electrodes 13*b*1 and 13*b*2 are formed to face the fixed contact electrodes 14*a*1 and 14*a*2, respectively, in each contact beam 12*a* arranged to face the fixed contact electrodes 14*a*1 and 14*ab*. Thereby, like the first embodiment, the contact structure in which the contact point pairs 10*b* each constituted of the fixed contact electrodes 14*a*1 and 14*a*2, the movable contact electrodes 13*b*1 and 13*b*2, and the contact beam 12*a* are parallelized is realized. Therefore, also in this embodiment, by the slide operation of the pushrod 12, it is possible to perform each contact operation in each contact point pair 10*b* independently from each other, while collectively performing the contact operation for all the contact point pairs 10*b* at the same time. Accordingly, the contact between the fixed contact electrode 14*a*1 and the movable contact electrode 13*b*1, and the contact between the fixed contact electrode 14*a*2 and the movable contact electrode 13*b*2 are substantially uniformly established in all the contact point pairs 10*b* with sufficient contact pressure. Thus, it is possible to obtain the same effects as the first embodiment.

3. Third Embodiment

Figure 5A:
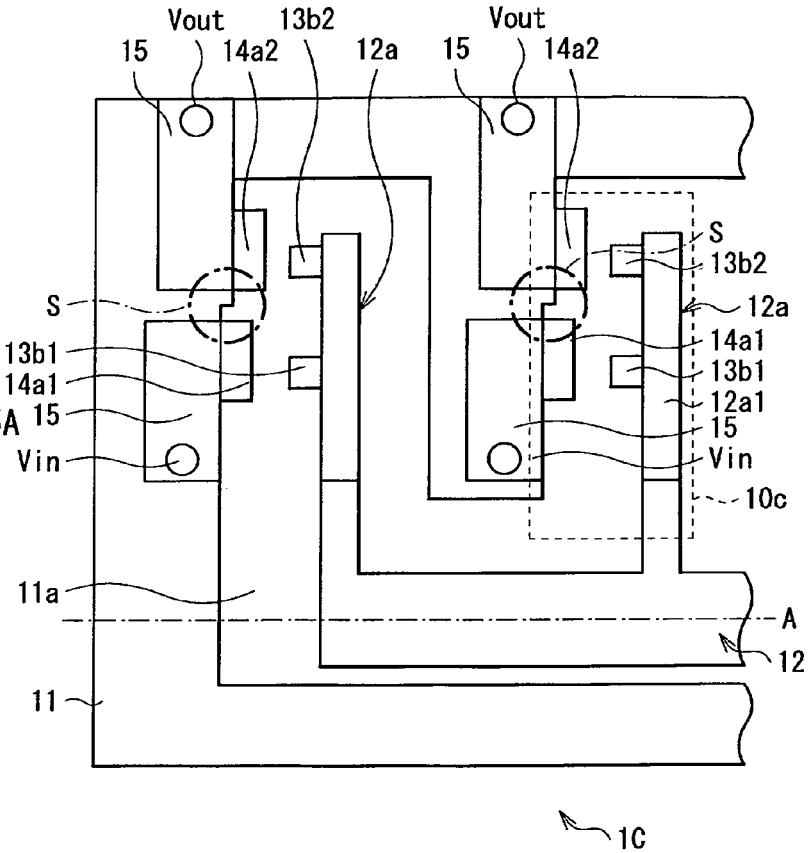
FIGS. 5A to 5C are plan views illustrating the schematic structure of the contact switch according to a third embodiment.
Figure 5B:
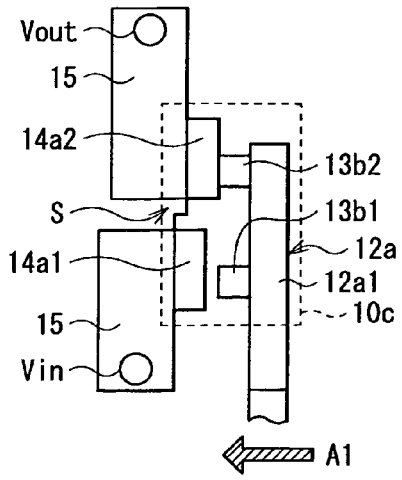
Figure 5C:
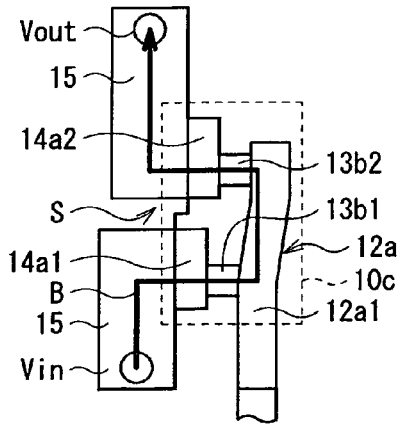

FIG. 5A illustrates the plan structure (the off-state) in the vicinity of the contact point pair (a contact point pair 10*c*) of the contact switch (a contact switch 1C) according to a third embodiment. FIG. 5B illustrates the contact point pair 10*c* in the transition state from the non-contact state to the contact state. FIG. 5C illustrates the contact point pair 10*c* in the contact state (the on-state), and an arrow B in FIG. 5C schematically illustrates a signal flow. In addition, same reference numerals will be used for components substantially identical to those in the schematic structure and the first and second embodiments described above, and description will be appropriately omitted.

Like the contact switch 1A in the first embodiment, the contact switch 1C is the series type switch in which the plurality of contact point pairs 10*c* are arranged in parallel on the substrate 11, and the mechanical coupling/decoupling of the transmission line 15 is performed by the slide operation of the pushrod 12. On the wall of the cavity 11*a* formed on the substrate 11, the two transmission lines 15 in which the input port Vin and the output port Vout are formed, and the two fixed contact electrodes 14*a*1 and 14*a*2 connected to the transmission lines 15, respectively, are provided. The contact beam 12*a* is projected from the pushrod 12 to face the fixed contact electrodes 14*a*1 and 14*a*2, and the elastic modulus of the contact beam 12*a* is smaller than that of the pushrod 12. Further, like the contact switch 1B of the second embodiment, the two movable contact electrodes 13*b*1 and 13*b*2 are provided to the two fixed contact electrodes 14*a*1 and 14*a*2 in each contact point pair 10*c*.

However, in this embodiment, a step S is provided between the fixed contact electrode 14*a*1 and the fixed contact electrode 14*a*2. Specifically, the step S is formed on the wall of the cavity 11*a*, the two transmission lines 15 are provided with the step S in between, and the fixed contact electrodes 14*a*1 and the fixed contact electrode 14*a*2 are provided on the transmission lines 15, respectively. With the step S, the distance between the contact points located closer to the pushrod 12 (on the base side of the contact beam 12*a*) is wider than the distance between the contact points located more away from the pushrod 12 (on the end side of the contact beam 12*a*). In other words, here, the distance between the fixed contact electrode 14*a*1 and the movable contact electrode 13*b*1 is wider than the distance between the fixed contact electrode 14*a*2 and the movable contact electrode 13*b*2. This height difference by the step S is preferably set in consideration of variation in the film thickness generated when forming the films, and the warpage amount of the contact beam 12*a*.

Thereby, like the first embodiment, when the pushrod 12 slides (displaces) along the operation axis A by the drive of the actuator 20, which is not illustrated in the figure, the contact state and the non-contact state in the contact point pair 10*c* are switched by the slide operation in this embodiment. When the contact point pair 10*c* is in the non-contact state, the transmission line 15 from the input port Vin to the output port Vout is mechanically decoupled, and switched off (FIG. 5A). Meanwhile, as illustrated in FIG. 5B, when the contact point pair 10*c* is in the transition state from the non-contact state to the contact state, the contact beam 12*a* is displaced toward a direction A1, and the movable contact electrode 13*b*2 located on the end side of the contact beam 12*a* is in contact with the fixed contact electrode 14*a*2 facing the movable contact electrode 13*b*2 first. After that, or at the substantially same time, the movable contact electrode 13*b*1 located on the base side of the contact beam 12*a* is in contact with the fixed contact electrode 14*a*1 facing the movable contact electrode 13*b*1 (FIG. 5C). Thereby, the transmission line 15 from the input port Vin to the output port Vout is mechanically coupled by the contact point pair 10*c*, and switched on. Specifically, a signal input from the input port Vin side is output to the output port Vout through the fixed contact electrode 14*a*1, the movable contact electrode 13*b*1, the contact beam 12*a* (the stacked film 12*a*1), the movable contact electrode 13*b*2, and the fixed contact electrode 14*a*2 in this order.

Here, the plurality of the pairs of fixed contact electrodes 14*a*1 and 14*a*2 are arranged in parallel on the substrate 11, and the two movable contact electrodes 13*b*1 and 13*b*2 are formed to face the fixed contact electrodes 14*a*1 and 14*a*2 in each contact beam 12*a* arranged to face the fixed contact electrodes 14*a*1 and 14*ab*. Thereby, like the first embodiment, the contact structure in which the contact point pairs 10*c* each constituted of the fixed contact electrodes 14*a*1 and 14*a*2, the movable contact electrodes 13*b*1 and 13*b*2, and the contact beam 12*a* are parallelized is realized. Therefore, also in this embodiment, the contact between the fixed contact electrode 14*a*1 and the movable contact electrode 13*b*1, and the contact between the fixed contact electrode 14*a*2 and the movable contact electrode 13*b*2 are substantially uniformly established in all the contact point pairs 10*c* with sufficient contact pressure. Thus, it is possible to obtain the same effects as the first embodiment.

Figure 6:
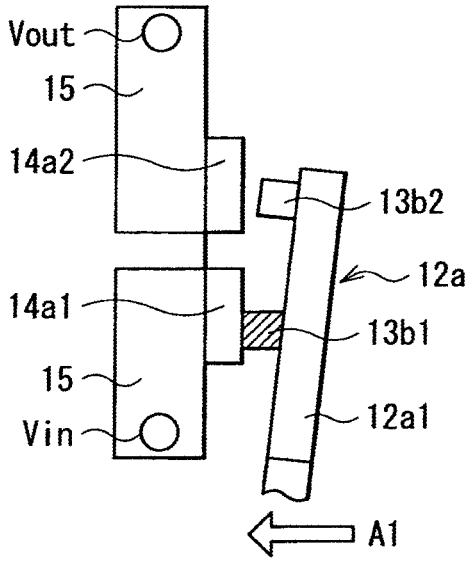
FIG. 6 is a schematic view for explaining efficiency of the contact switch illustrated in FIGS. 5A to 5C.

Further, in this embodiment, the predetermined step S is provided between the fixed contact electrode 14*a*1 and the fixed contact electrode 14*a*2, so the distance between the contact points located closer to the pushrod 12 is wider than the distance between the contact points located more away from the pushrod 12. Here, when all the contact points are in the non-contact state in the contact beam 12*a*, the base portion of that contact beam 12*a* (connection portion of the contact beam 12*a* and the pushrod 12) serves as the fulcrum, but after any of the contact points are brought into contact by displacement of the contact beam 12*a*, that contact position becomes a new fulcrum of the contact beam 12*a*. When it is assumed that there is a structure in which the contact points (the fixed contact electrode 14*a*1 and the movable contact electrode 13*b*1) located closer to the pushrod 12 are brought into contact first due to film-formation variation or the like, for example, as illustrated in FIG. 6, the contact beam 12*a* is easily deformed by that contact position as the fulcrum. Thus, a long stroke or a strong force, or both of them are necessary to bring the contact points (the fixed contact electrode 14*a*2 and the movable contact electrode 13*b*2) located more away from the pushrod 12 into contact. Accordingly, the size of the actuator is increased, so the size of the device is increased. Such a worst case may occur that the contact points are not in contact with each other, and the switching operation is easily unstable.

In this embodiment, the fixed contact electrode 14*a*2 and the movable contact electrode 13*b*2 located more away from the pushrod 12 are brought into contact earlier (or at the substantially same time) than the fixed contact electrode 14*a*1 and the movable contact electrode 13*b*1 located closer to the pushrod 12 by providing the step S. Thereby, even if the film-formation variation as described above is generated, contact failure (in particular, contact failure on the end side of the contact beam 12*a*) due to the deformation of the contact beam 12*a* is prevented, and it is thus possible to uniformize the contact pressure of the contact points in each contact point pair 10*c*.

Figure 7A:
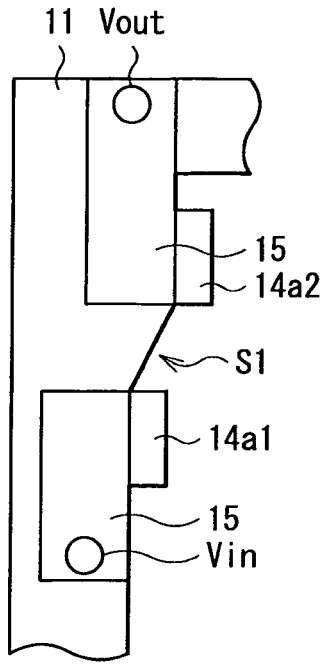
FIGS. 7A and 7B are plan views illustrating the schematic structure of a modification of the contact switch illustrated in FIGS. 5A and 5B.
Figure 7B:
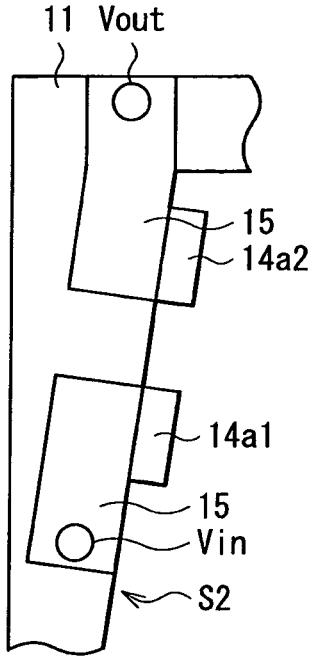

In addition, in the third embodiment, although the case where the one step S is provided in each contact point pair 10*c* has been described as an example, the number of the steps S may be two or more, that is, multiple steps may be provided between the fixed contact electrode 14*a*1 and the fixed contact electrode 14*a*2. The means of varying the distance between the contact points is not limited to the step S, but a taper S1 illustrated in FIG. 7A may be used. Alternatively, as illustrated in FIG. 7B, a taper S2 is provided in a wide range on a wall of the cavity 11*a*, and the fixed contact electrodes 14*a*1 and 14*a*2 may be provided on the inclined surface by the taper S2.

4. Fourth Embodiment

Figure 8A:
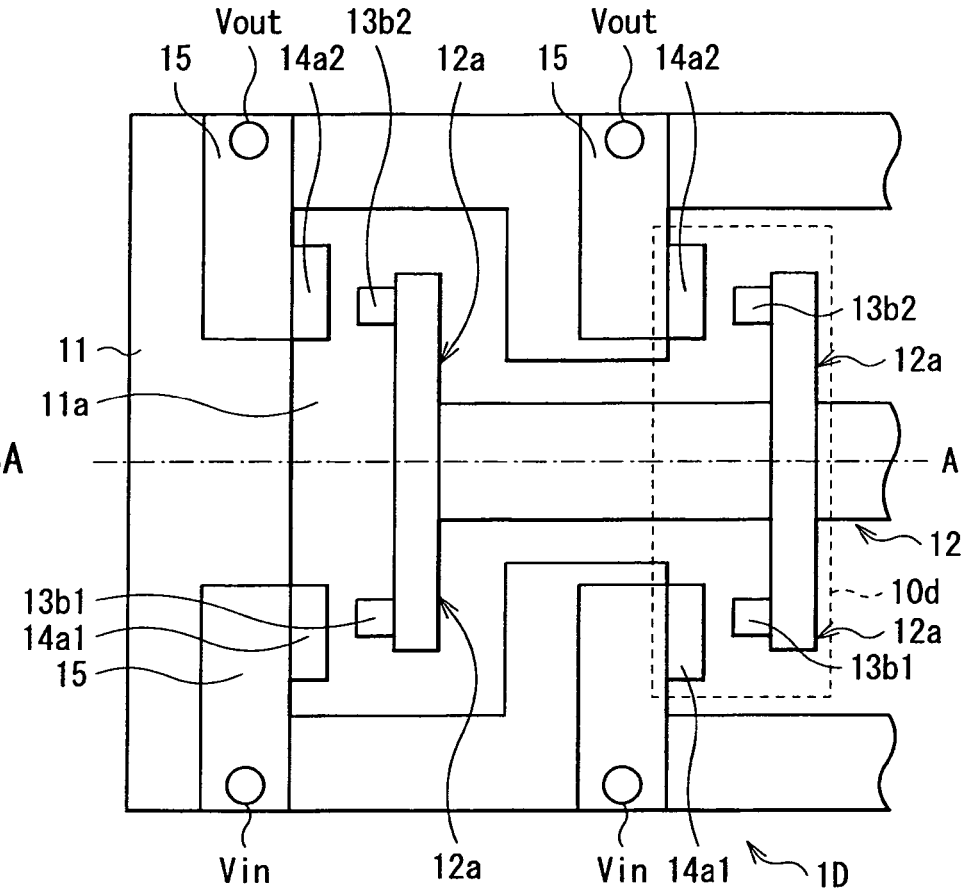
FIGS. 8A and 8B are plan views illustrating the schematic structure of the contact switch according to a fourth embodiment.
Figure 8B:
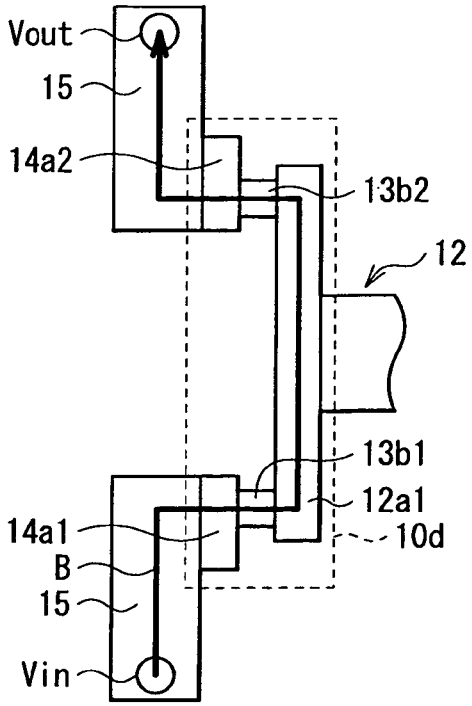

FIG. 8A illustrates the plan structure (the off-state) in the vicinity of the contact point pair (a contact point pair 10*d*) of the contact switch (a contact switch 1D) according to a fourth embodiment. FIG. 8B illustrates the contact point pair 10*d* in the contact state (the on-state), and an arrow B in the figure schematically illustrates a signal flow. In addition, same reference numerals will be used for components substantially identical to those in the schematic structure and the first and second embodiments described above, and description will be appropriately omitted.

Like the contact switch 1A in the first embodiment, the contact switch 1D is the series type switch in which the plurality of contact point pairs 10*d* are arranged in parallel on the substrate 11, and the mechanical coupling/decoupling of the transmission line 15 is performed by the slide operation of the pushrod 12. On the wall of the cavity 11*a* formed on the substrate 11, the two transmission lines 15 in which the input port Vin and the output Vout are formed, and the two fixed contact electrodes 14*a*1 and 14*a*2 connected to the transmission lines 15, respectively, are provided. The contact beam 12*a* is projected from the pushrod 12 to face the fixed contact electrodes 14*a*1 and 14*a*2, and the elastic modulus of the contact beam 12*a* is smaller than that of the pushrod 12. Further, like the contact switch 1B of the second embodiment, the two movable contact electrodes 13*b*1 and 13*b*2 are provided to the two fixed contact electrodes 14*a*1 and 14*a*2 in each contact point pair 10*d*.

However, in this embodiment, the contact beam 12*a* is projected on both sides along the direction orthogonal to the operation axis A of the pushrod 12. Further, the fixed contact electrodes 14*a*1 and 14*a*2, the movable contact electrodes 13*b*1 and 13*b*2, and the contact beam 12*a* are provided to be line-symmetric by the operation axis A of the pushrod 12 as a symmetric axis. In other words, a group constituted of the fixed contact electrode 14*a*1, the movable contact electrode 13*b*1, and the contact beam 12*a*, and a group constituted of the fixed contact electrode 14*a*2, the movable contact electrode 13*b*2, and the contact beam 12*a* are line-symmetric to each other in each contact point pair 10*d*.

Thereby, like the first embodiment, when the pushrod 12 slides (displaces) along the operation axis A by the drive of the actuator 20, which is not illustrated in the figure, the contact state and the non-contact state in the contact point pair 10*d* are switched by the slide operation in this embodiment. When the contact point pair 10*d* is in the non-contact state, the transmission line 15 from the input port Vin to the output port Vout is mechanically decoupled, and switched off (FIG. 8A). Meanwhile, when the contact point pair 10*d* is in the contact state, the transmission line 15 from the input port Vin to the output port Vout is mechanically coupled by the contact point pair 10*d*, and switched on (FIG. 8B). Specifically, a signal input from the input port Vin side is output to the output port Vout through the fixed contact electrode 14*a*1, the movable contact electrode 13*b*1, the contact beam 12*a* (the stacked film 12*a*1), the movable contact electrode 13*b*2, and the fixed contact electrode 14*a*2 in this order.

Hereinafter, an example of a wiring layout and the actuator 20 in the contact switch described in the schematic structure example and the first to fourth embodiments will be described. In addition, the structure of the contact switch 1D of the fourth embodiment will be used in the description on behalf of these embodiments.

Wiring Layout Example

Figure 9:
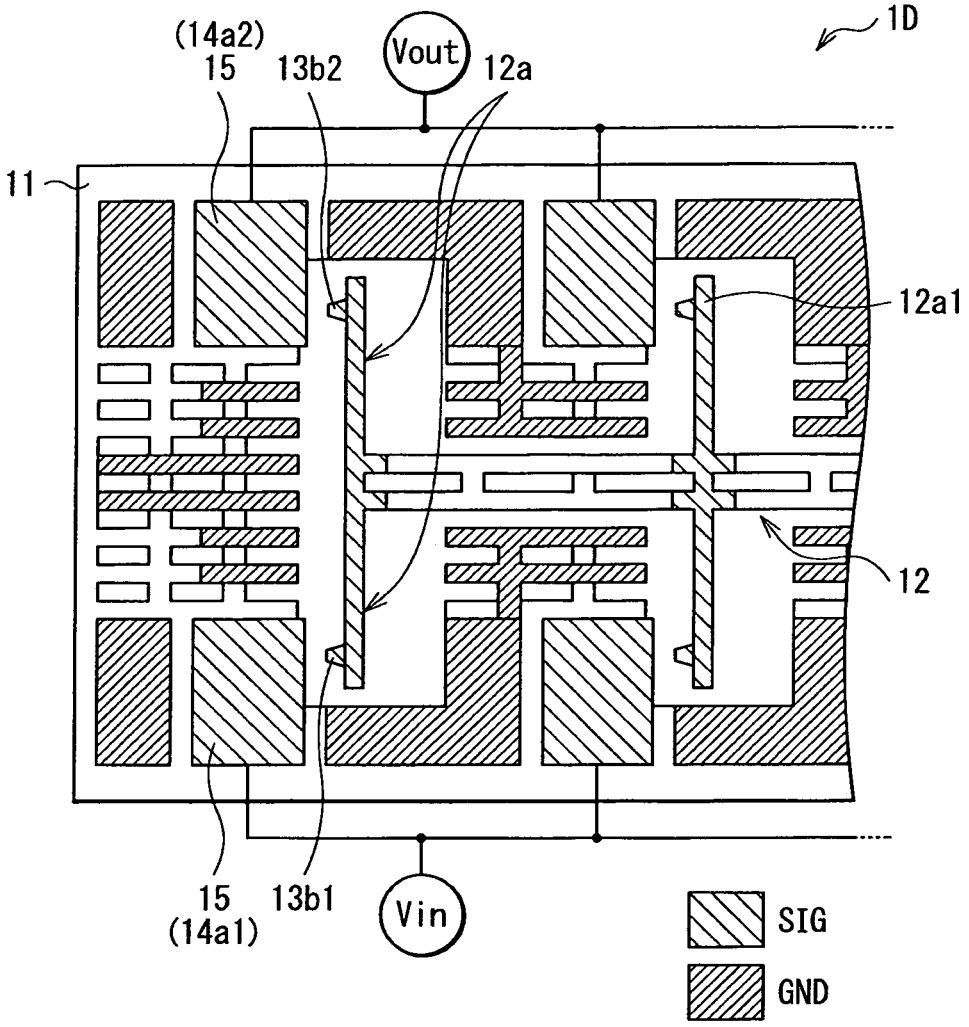
FIG. 9 is a plan view illustrating an example of a wiring layout of the contact switch illustrated in FIGS. 8A and 8B.

FIG. 9 schematically illustrates a specific wiring layout in the contact switch 1D. The contact switch 1D has a GSGSG structure in which a signal line SIG (corresponding to the transmission line 15, the fixed contact electrodes 14*a*1 and 14*a*2, the movable contact electrodes 13*b*1 and 13*b*2, and the contact beam 12*a*) and a ground line GND are substantially alternately arranged on the substrate 11. The ground line GND is provided as a fixed electrode set at a ground potential on an insulating film on the surface of the substrate 11.

With this wiring layout, it is possible to reduce power loss in a high-frequency signal in particular. The reasons are as follows. That is, the transmission line 15 is formed on the substrate 11 through the insulating film (not illustrated in the figure), and when a signal is input to the transmission line 15 on the insulating film, the input signal is likely to be irradiated to the ground line GND. Thus, in the case where the ground line GND is arranged in a position away from the transmission line 15, the signal irradiation amount is increased. Accordingly, like this layout example, the ground line GND is arranged in the vicinity of the transmission line 15 by employing the GSGSG structure, and it is possible to reduce the signal irradiation amount and the power loss.

In this layout example, a part of the cavity 11*a* has a ladder structure, and the ground line GND is formed also in the ladder structure portion. Further, although the pushrod 12 and the contact beam 12*a* are each formed of a plate member of the same material with the same thickness as each other, the contact beam 12*a* is formed to be regarded as the elastic body and the pushrod 12 is formed to be regarded as the rigid body. Specifically, the contact beam 12*a* is regarded as the elastic body, for example, by using the one plate member of a silicon semiconductor with a thickness of approximately 0.5 μm to 4.0 μm both inclusive. Meanwhile, the pushrod 12 is regarded as the rigid body by forming the ladder structure from a combination of a plurality of plate members of the same material with the same thickness as the contact beam 12*a* to increase the mechanical strength.

Structural Example of Actuator 20

Figure 10A:
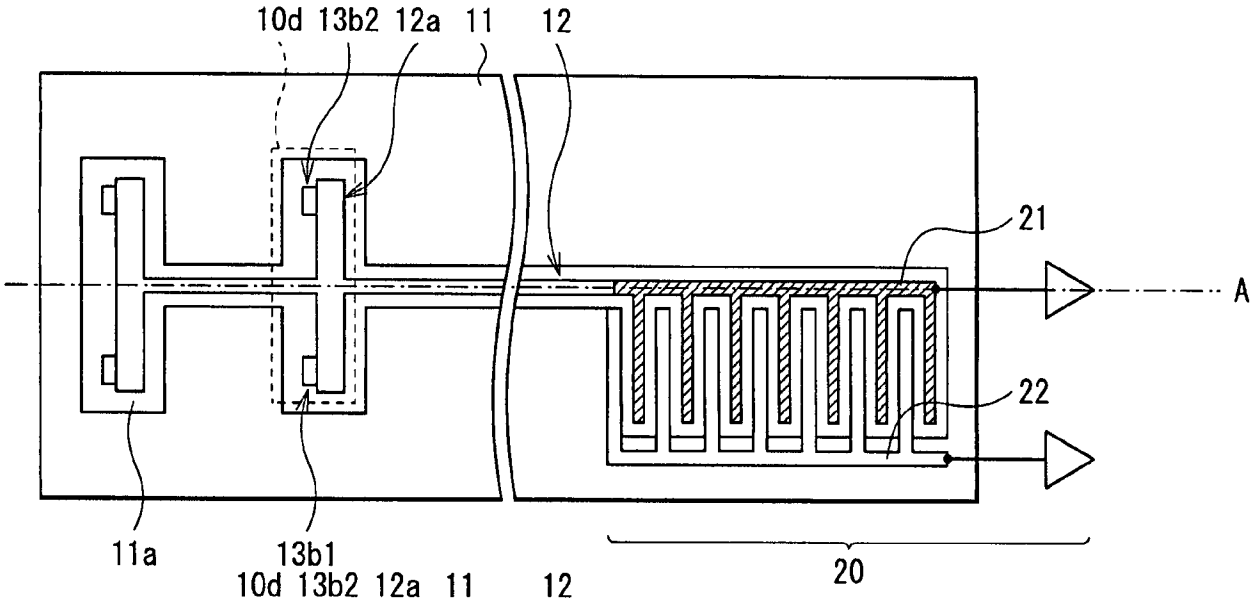
FIGS. 10A and 10B are plan views illustrating an example of an actuator of the contact switch illustrated in FIGS. 8A and 8B.
Figure 10B:
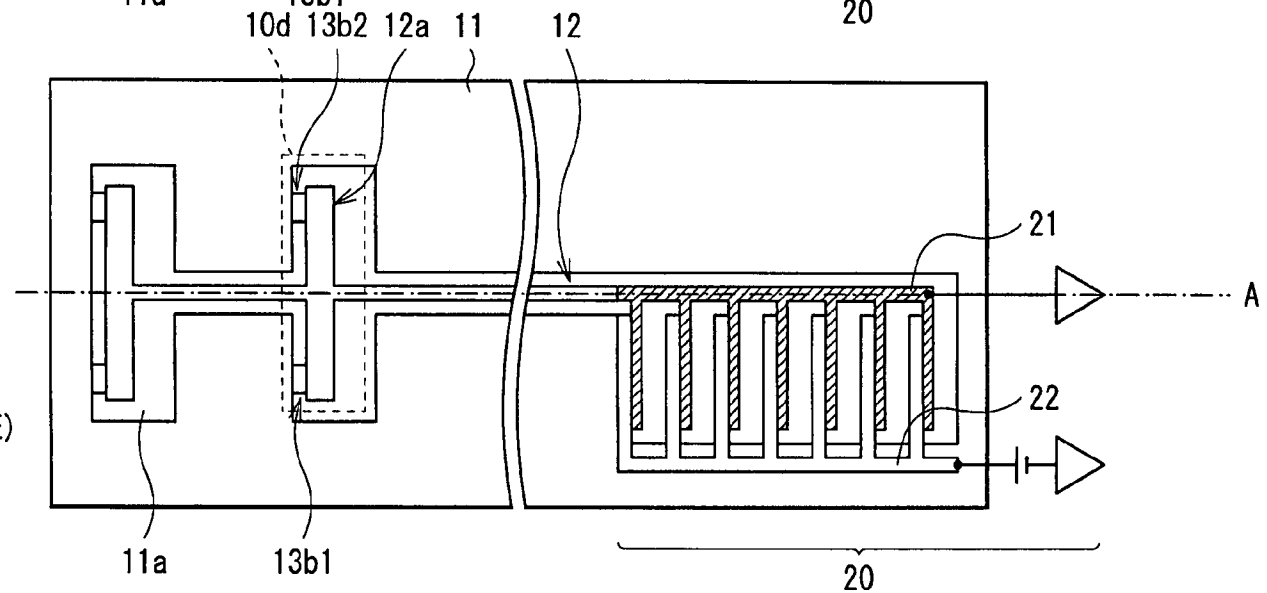

FIGS. 10A and 10B illustrate the schematic structure of the actuator 20. In the contact switch 1D, the actuator 20 is formed by processing the substrate 11 through the MEMS technique, that is, the transmission line 15, the contact point pair 10*d*, the pushrod 12, and the actuator 20 are provided in the same horizontal plane on the substrate 11. The actuator 20 as being a so-called electrostatic MEMS actuator by a lateral drive includes a movable electrode 21 sliding along the same operation axis (the operation axis A) as the pushrod 12, and a fixed electrode 22 fixed to the substrate 11, and displaces the movable electrode 21 along the operation axis A by electrostatic force. In addition, in FIGS. 10A and 10B, the transmission line 15 and the fixed contact electrode 141*a*1 and 141*a*2 are omitted to be illustrated for the sake of simplicity.

The movable electrode 21 and the fixed electrode 22 each are a comb-shaped electrode, and are arranged to engage with each other. The movable electrode 21 and the fixed electrode 22 are formed, for example, as will be described next. That is, after a comb-shaped base material is formed by three-dimensionally processing the substrate 11 through etching and lithography technique, the surface of the base material is covered with the same type of a stacked film (a stacked film of gold and titanium) as the fixed contact electrodes 14*a*1 and 14*a*2, or the like, thereby forming the movable electrode 21 and the fixed electrode 22. The movable electrode 21 is copulatively or integrally formed with the pushrod 12, and the pushrod 12 slides with the slide operation of the movable electrode 21. In the movable electrode 21 and the fixed electrode 22, electromagnetic force is generated as drive force by application of a voltage from a power source (not illustrated in the figure), and the movable electrode 21 is thereby suctioned on the fixed electrode 22 side.

Thereby, in the off state in which no voltage is applied (FIG. 10A), when the actuator 20 receives a command of a close operation (switching to the on-state), and a drive voltage is applied between the movable electrode 21 and the fixed electrode 22, electromagnetic force is generated between the movable electrode 21 and the fixed electrode 22. As a result, the movable electrode 21 slides along the operation axis A to be close to the fixed electrode 22. Correspondingly, the pushrod 12 slides, and the contact in the contact point pair 10*d* is established to be in the on-state (FIG. 10B). In addition, in the on-state, when the actuator 20 receives a command of an open operation (switching to the off-state), electromagnetic force between the movable electrode 21 and the fixed electrodes 22 is released, and the movable electrode 21 slides along the operation axis A to be not in contact with the fixed electrode 22. Correspondingly, the pushrod 12 slides, the contact in the contact point pair 10*d* is canceled, and the components return to the positions illustrated FIG. 10A.

Here, although the electrostatic actuator is exemplified as the actuator 20, it is possible to apply the actuator 20 to actuators by other drive methods utilizing the MEMS function, for example, a piezoelectric actuator, an electromagnetic actuator, and a bimetallic actuator.

Application Example

Figure 11:
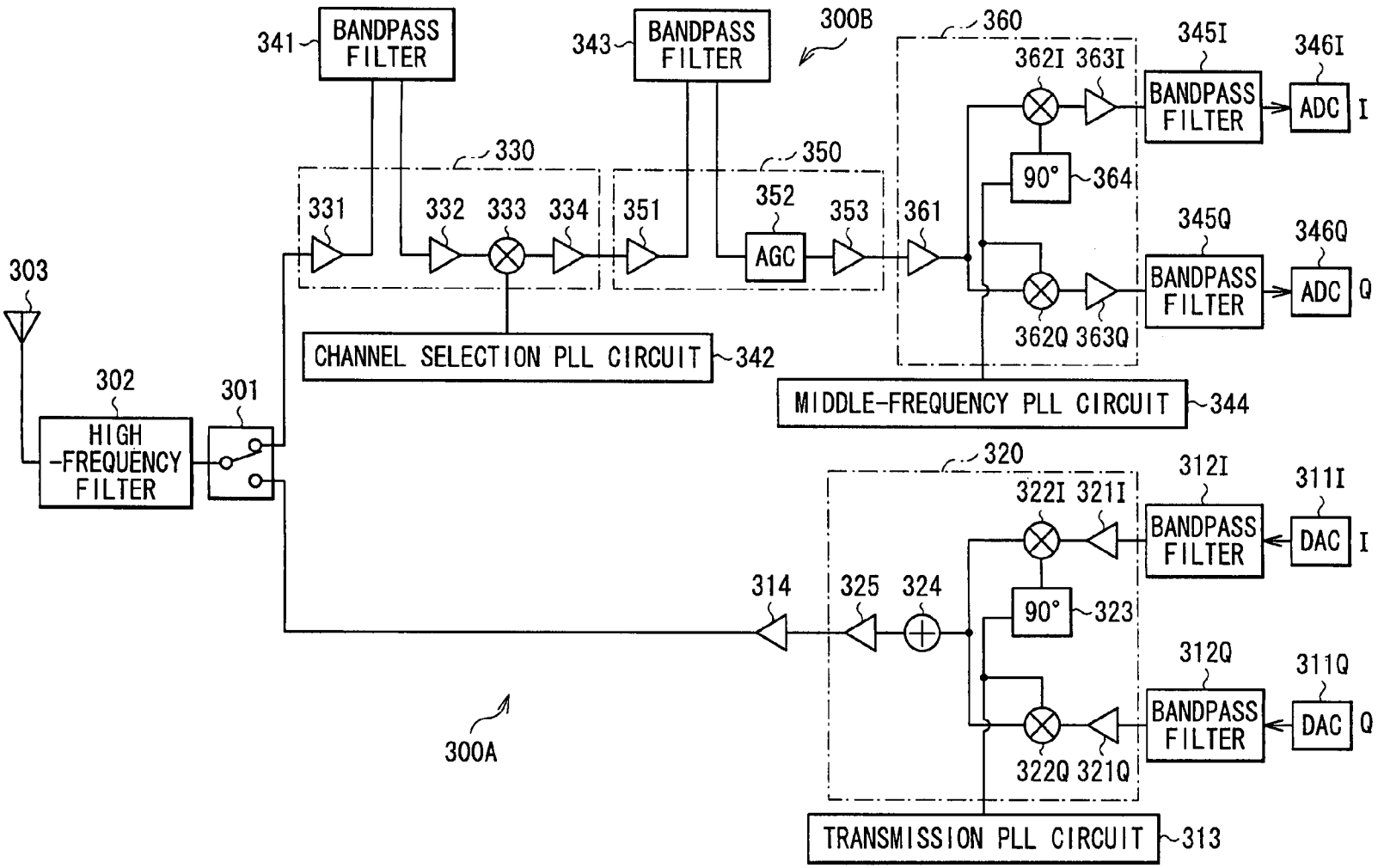
FIG. 11 is a functional block diagram illustrating an electronic device according to an application example of the contact switch.

FIG. 11 illustrates the block structure of a communication device (an electronic device) equipped with the contact switch of the present invention. The communication device is equipped with the contact switch described in the embodiments as a transmission/reception switcher 301, and is, for example, a portable phone, an information portable terminal (PDA), and a wireless LAN device. In addition, the transmission/reception switcher 301 is formed in a semiconductor device of SoC. This communication device includes a transmission circuit 300A, a reception circuit 300B, the transmission/reception switcher 301 switching a transmission path and a reception path, a high-frequency filter 302, and a transmission/reception antenna 303.

The transmission circuit 300A includes two digital/analogue converters (DAC) 311I and 311Q and two bandpass filters 312I and 312Q corresponding to transmission data of an I channel and transmission data of a Q channel, a modulator 320, a transmission PLL (phase-locked loop) circuit 313, and a power amplifier 314. The modulator 320 includes two buffer amplifiers 321I and 321Q and two mixers 322I and 322Q corresponding to the above-described two bandpass filters 312I and 312Q, a phase shifter 323, an adder 324, and a buffer amplifier 325.

The reception circuit 300B includes a high-frequency section 330, a bandpass filter 341 and a channel selection PLL circuit 342, a middle-frequency circuit 350 and a bandpass filter 343, a demodulator 360 and a middle-frequency PLL circuit 344, and two bandpass filters 345I and 345Q and two analogue/digital convertors (ADC) 346I and 346Q corresponding to reception data of the I channel and reception data of the Q channel. The high-frequency section 330 includes a low-noise amplifier 331, buffer amplifiers 332 and 334, and a mixer 333, and the middle-frequency circuit 350 includes buffer amplifiers 351 and 353, and an auto gain controller (AGC) circuit 352. The demodulator 360 includes a buffer amplifier 361, two mixers 362I and 362Q and two buffer amplifiers 363I and 363Q corresponding to the above-described two bandpass filters 345I and 345Q, and a phase shifter 364.

In this communication device, when the transmission data of the I channel and the transmission data of the Q channel are input to the transmission circuit 300A, each transmission data is processed by the following procedures. That is, first, the transmission data is converted into an analogue signal in the DACs 311I and 311Q, and after a signal component other than a transmission signal band is removed from the transmission signal in the bandpass filters 312I and 312Q, the resultant transmission signal is supplied to the modulator 320. Next, in the modulator 320, the resultant transmission signal is supplied to the mixers 322I and 322Q through the buffer amplifiers 321I and 321Q, and after a frequency signal corresponding to a transmission frequency supplied from the transmission PLL circuit 313 is mixed to the resultant transmission signal and modulated, both mixed signals are added in the adder 324 to obtain one transmission signal. At this time, in the frequency signal supplied to the mixer 322I, a signal phase is shifted by 90° in the phase shifter 323 so that the signal of the I channel and the signal of the Q channel are modulated orthogonally to each other. Finally, the signal is supplied to the power amplifier 314 through the buffer amplifier 325 to amplify the signal to have a predetermined transmission power. The signal amplified in the power amplifier 314 is supplied to the antenna 303 through the transmission/reception switcher 301 and the high-frequency filter 302, and the signal is thereby radio-transmitted through the antenna 303. The high-frequency filter 302 serves as a bandpass filter removing a signal component other than a high-frequency band from a signal transmitted from or received in the communication device.

Meanwhile, when a signal from the antenna 303 is received in the reception circuit 300B through the high-frequency filter 302 and the transmission/reception switcher 301, the signal is processed in the following procedures. That is, first, the reception signal is amplified by the low noise amplifier 331 in the high-frequency section 330, and after a signal component other than a reception frequency band is removed from the amplified reception signal in the bandpass filter 341, the resultant reception signal is supplied to the mixer 333 through the buffer amplifier 332. Next, a frequency signal supplied from the channel selection PPL circuit 342 is mixed to the resultant reception signal to obtain a middle frequency signal from the signal of the predetermined reception channel, and the middle frequency signal is supplied to the middle-frequency circuit 350 through the buffer amplifier 334. Next, in the middle-frequency circuit 350, the middle frequency signal is supplied to the bandpass filter 343 through the buffer amplifier 351 to remove the signal component other than the band of the middle frequency signal from the middle frequency signal, and after the resultant signal is formed into a substantially constant gain signal in the AGC circuit 352, the gain signal is supplied to the demodulator 360 through the buffer amplifier 353. Next, in the demodulator 360, after the signal is supplied to the mixers 362I and 362Q through the buffer amplifier 361, the frequency signal supplied from the middle frequency PPL circuit 344 is mixed into the signal to demodulate the signal component of the I channel and the signal component of the Q channel. At this time, in the frequency signal supplied to the mixer 3621, the signal phase is shifted by 90° in the phase shifter 364 so that the signal component of the I channel and the signal component of the Q channel modulated orthogonally to each other are demodulated. Finally, after the signal component other than the signal of the I channel and the signal of the Q channel is removed from the middle frequency signal supplied from the demodulator 360 by supplying the signal of the I channel and the signal of the Q channel to the band pass filters 345I and 345Q, respectively, the resultant signals are supplied to the ADCs 346I and 346Q, and converted into digital data. Thereby, it is possible to obtain the reception data of the I channel and the reception data of the Q channel.

This communication device is equipped with the contact switch described in the above-described embodiments as the transmission/reception switcher 301, and thus has excellent high-frequency characteristic by actions described in the above-described embodiments.

In addition, in this communication device, the case where the contact switch described in the above-described embodiments is applied to the transmission/reception switcher 301 (the semiconductor device) has been described, it is not necessarily limited to this. For example, the contact switch may be applied to the mixers 322I, 322Q, 333, 362I, and 362Q, the bandpass filters 312I, 312Q, 341, 343, 354I, and 345Q, or the high-frequency filter 302 in the transmission circuit 300A and the reception circuit 300B. Also in this case, the same effects as those described above can be obtained.

Hereinbefore, although the present invention has been described with the embodiments, the present invention is not limited to the above-described embodiments, and various modifications may be made. For example, the material, the thickness, the film-formation method, and the like of each layer are not limited to those described in the embodiments, and other materials, other thickness, and other film-formation methods may be adopted.

In the above-described embodiments, although the description has been specifically given with the structure of the contact switches 1, and 1*a* to 1*d*, it is not necessary to include all the components, and other components may be further included.

The present application contains subject matter related to that disclosed in Japanese Priority Patent Application JP 2010-020372 filed in the Japan Patent Office on Feb. 1, 2010, the entire contents of which is hereby incorporated by reference.

It should be understood by those skilled in the art that various modifications, combinations, sub-combinations and alternations may occur depending on design requirements and other factors insofar as they are within the scope of the appended claims or the equivalents thereof.

What is claimed is:

1. A lateral motion micro-electro-mechanical system contact switch comprising:

a plurality of first contact points arranged in parallel on a substrate;

a movable member including a plurality of beams facing the plurality of first contact points, and formed to be slidable along an alignment direction of the first contact points within a face of the substrate; and a plurality of second contact points provided on faces of the plurality of beams, opposing the first contact points, respectively, wherein each first contact point includes a plurality of fixed contact electrodes, and a movable contact electrode as the second contact point is provided to each fixed contact electrode in each one of the plurality of beams of the movable member, wherein the substrate includes a step between the plurality of fixed contact electrodes, and a space between the fixed contact electrode and the movable contact electrode on a base side of one of the plurality of beams is wider than that between the fixed contact electrode and the movable contact electrode on an end side of the one of the plurality of beams.

2. The lateral motion micro-electro-mechanical system contact switch according to claim 1, wherein the movable contact electrode is fabricated from a titanium film layer and a gold film layer stacked onto each other with the titanium film layer having a titanium film layer thickness of approximately 0.1 μm and the gold film layer having a gold film layer thickness of approximately 0.2 μm.

3. A lateral motion micro-electro-mechanical system contact switch comprising:

a plurality of first contact points disposed apart from one another and arranged in parallel on a substrate, wherein each first contact point includes a plurality of fixed contact electrodes and a movable contact electrode;

a movable member including a support body extending along an alignment direction of the plurality of first contact points and a plurality of beams projecting from the support body along a direction orthogonal to the alignment direction, the plurality of beams facing the plurality of first contact points, and formed to be slidable along the alignment direction of the first plurality of contact points within a face of the substrate, wherein the substrate includes a step between the plurality of fixed contact electrodes, and a space between the plurality of fixed contact electrodes and the movable contact electrode on a base side of one of the plurality of beams is wider than that between the plurality of fixed contact electrodes and the movable contact electrode on an end side of the one of the plurality of beams; and a plurality of second contact points provided on faces of the plurality of beams, opposing the plurality of first contact points, respectively, wherein an elastic modulus of the plurality of beams is smaller than that of the support body in the movable member such that when the movable member urges respective ones of the plurality of first and second contact points together, a contact pressure is imparted therebetween and each one of the plurality of beams is operative to flex as a result of a bending moment force being imparted to each one of the plurality of beams by the support body.

4. The lateral motion micro-electro-mechanical system contact switch according to claim 3, wherein the movable contact electrode as a second contact point is provided to each fixed contact electrode and the plurality of fixed contact electrodes, the movable contact electrode, and the each one of the plurality of beams are line-symmetrically arranged with an operation axis of the support body, serving as a symmetric axis.

5. The lateral motion micro-electro-mechanical system contact switch according to claim 3, wherein the movable contact electrode is provided to the plurality of fixed contact electrodes in each one of the plurality of beams of the movable member.

6. The lateral motion micro-electro-mechanical system contact switch according to claim 3, wherein the movable contact electrode is fabricated from a titanium film layer and a gold film layer stacked onto each other with the titanium film layer having a titanium film layer thickness of approximately 0.1 μm and the gold film layer having a gold film layer thickness of approximately 0.2 μm.

7. The lateral motion micro-electro-mechanical system contact switch according to claim 3, further comprising:

on the substrate:

a signal line electrically connected to each of the plurality of first contact points to transmit a signal; and a ground line arranged between the signal line.

8. The lateral motion micro-electro-mechanical system contact switch according to claim 3, wherein the movable contact electrode is provided to each fixed contact electrode in each one of the plurality of beams of the movable member.

9. The lateral motion micro-electro-mechanical system contact switch according to claim 3, further comprising:

a drive section switching the plurality of first contact points and the plurality of second contact points to either a contact state or a non-contact state by driving the movable member, wherein the drive section includes a Micro Electro Mechanical System (MEMS) actuator.

10. The lateral motion micro-electro-mechanical system contact switch according to claim 9, wherein the MEMS actuator is configured as an electrostatic MEMS actuator by a lateral drive.

11. A lateral motion micro-electro-mechanical system contact switch, comprising:

a substrate;

a first substrate electrode and a second substrate electrode fixedly connected to the substrate and projecting therefrom;

an actuator connected to the substrate;

a movable member operably connected to the actuator and including a rigid support member extending along an operative axis, a first beam integrally connected to the support member at a first distance from the actuator and extending perpendicularly to the operative axis and a second beam integrally connected to the support member at a second distance from the actuator and extending perpendicularly from the operative axis, the first distance being larger than the second distance, the first and second beams being stiff yet pliable; and a first movable electrode fixedly connected to and projecting from the first beam along an operative axis direction, disposed apart from the support member and facially opposing the first substrate electrode and a second movable electrode fixedly connected to and projecting from the second beam along the operative axis direction, disposed apart from the support member and facially opposing the second substrate electrode, wherein, the lateral motion micro-electro-mechanical system contact switch moves to and between an OFF state and an ON state, such that, in the OFF state, the support member is retracted along the operative axis by the actuator causing respective ones of the first and second movable electrodes to move away from respective ones of the first and second substrate electrodes and, in the ON state, the support member is extended along the operative axis by the actuator causing the respective ones of the first and second movable electrodes to facially contact the respective ones of the first and second substrate electrodes at applied contact pressures while imparting bending forces on respective ones of the first and second beams.

12. A lateral motion micro-electro-mechanical system contact switch according to claim 11, wherein, in the ON state, respective ones of the first and second beams are disposed apart from the substrate forming a gap therebetween.

13. A lateral motion micro-electro-mechanical system contact switch according to claim 11, wherein the first beam and the second beam are elastic bodies.

14. A lateral motion micro-electro-mechanical system contact switch according to claim 11, wherein at least the first beam has a beam elastic modulus and the support member has a support member elastic modulus being greater than the beam elastic modulus.

* * * * *